US008161687B2

(12) United States Patent
Crettol et al.

(10) Patent No.: US 8,161,687 B2
(45) Date of Patent: Apr. 24, 2012

(54) PNEUMATIC SUPPORT STRUCTURE

(75) Inventors: Rene Crettol, Reinach (CH); Rolf Luchsinger, Uster (CH)

(73) Assignee: Prospective Concepts AG, Glattbrugg (CH)

( * ) Notice: Subject to any disclaimer, the term of this patent is extended or adjusted under 35 U.S.C. 154(b) by 388 days.

(21) Appl. No.: 12/308,416

(22) PCT Filed: May 11, 2007

(86) PCT No.: PCT/CH2007/000236

§ 371 (c)(1),
(2), (4) Date: Feb. 20, 2009

(87) PCT Pub. No.: WO2007/147270

PCT Pub. Date: Dec. 27, 2007

(65) Prior Publication Data

US 2010/0011674 A1 Jan. 21, 2010

(30) Foreign Application Priority Data

Jun. 23, 2006 (CH) ..... 1013/06

(51) Int. Cl.
*E04H 15/20* (2006.01)

(52) U.S. Cl. ..... 52/2.13; 52/2.22; 52/2.24

(58) Field of Classification Search ..... 52/2.13, 52/2.22, 2.23, 2.24

See application file for complete search history.

(56) References Cited

U.S. PATENT DOCUMENTS

| | | | | |
|---|---|---|---|---|
| 2,990,837 | A * | 7/1961 | Cushman | 52/2.19 |
| 4,676,032 | A * | 6/1987 | Jutras | 52/2.17 |
| 5,526,610 | A * | 6/1996 | Delamare | 52/2.24 |
| 6,543,730 | B2 * | 4/2003 | Pedretti | 248/52 |
| 2002/0157322 | A1 * | 10/2002 | Pedretti | 52/2.13 |
| 2004/0074151 | A1 * | 4/2004 | Morris | 52/2.22 |
| 2006/0192048 | A1 * | 8/2006 | Pedretti et al. | 244/24 |
| 2006/0273233 | A1 * | 12/2006 | Pedretti et al. | 248/560 |
| 2009/0282746 | A1 * | 11/2009 | Luchsinger | 52/2.11 |

FOREIGN PATENT DOCUMENTS

| | | |
|---|---|---|
| EP | 1210489 | 6/2002 |
| WO | WO-0173245 | 10/2001 |
| WO | WO-2004083568 | 9/2004 |
| WO | WO-2005042880 | 5/2005 |
| WO | WO-2007071101 A1 | 6/2007 |

OTHER PUBLICATIONS

Topcuoglu, Sadik Cem, International Search Report for PCT/CH2007/000236 as mailed Mar. 8, 2007 (6 pages).

* cited by examiner

*Primary Examiner* — Robert Canfield
*Assistant Examiner* — Babajide Demuren
(74) *Attorney, Agent, or Firm* — Winstead PC

(57) ABSTRACT

Disclosed is a support structure comprising a tension-compression element (1) which is composed of tension-compression bars (2) that are connected in real joints (3) as well as tension straps (4) that extend from one joint (3) to another (3). The outermost tension-compression bars (2) are connected in one respective knot (9). Two pressurized hollow members that are surrounded by a cover (6) are arranged on both sides of a plane that extends through the tension-compression element (1) such that the linear tensions σ generated in the cover (6) preload the tension straps (4) on the plane of the tension-compression element (1), secure the tension-compression bars (2) against bending, and stabilize the joints (3). The linear tensioning components that extend perpendicular to said plane of symmetry strut the tension-compression element (1) against lateral bending. Air-tight, optionally elastic pneumatic elements (7) can be inserted into the hollow members (5).

23 Claims, 7 Drawing Sheets

PNEUMATIC SUPPORT STRUCTURE

The present patent application relates to a foldable pneumatic support structure according to the introductory clause of Claim 1.

Several pneumatic support structures are known, also those with a foldable or rollable compression bar; likewise, support structures are known in which the compression bar or the compression bars can be joined together from individual elements. Thus, a pneumatic structure is known from EP 1 210 489 (D1), in which the compression bars can be joined together. In EP 04 716 193 (D2), the compression bars are constructed so that they can only receive compressive forces after the pneumatic structures are filled with compressed air. In the empty state, the described support structures are able to be rolled with bending radii which are not too small. In addition, from CH 02074/05 (D3) a pneumatic support structure is known, which has two tension-compression elements running longitudinally, which at the same time constricts the pneumatic structure in the manner of a double spindle, whereby on the one hand a preloading of the tension-compression elements is achieved with, at the same time, a greatly increased bending rigidity, and on the other hand the lateral stabilizing of the tension-compression elements is improved. For each of the essential features, each one of the said citations is regarded as the closest prior art.

The disadvantage of the above-mentioned compression bars is evident from all three said publications: The described pneumatic support structures are not really foldable, or the effort which must be made by the insertion of the dismembered individual parts of the compression bars, is great, and the precise positioning thereof is difficult.

The object of the present invention consists in providing a really foldable pneumatic support structure which, during unfolding, has a precisely positioned compression bar without external addition and hence overcomes the disadvantages of the known solutions.

The solution to the problem which is posed is expressed in the characterizing clause of Claim 1 with regard to its essential features and in the following claims with regard to further advantageous features.

The invention is described in further detail in several example embodiments in the enclosed drawings, in which.

Figure 4:
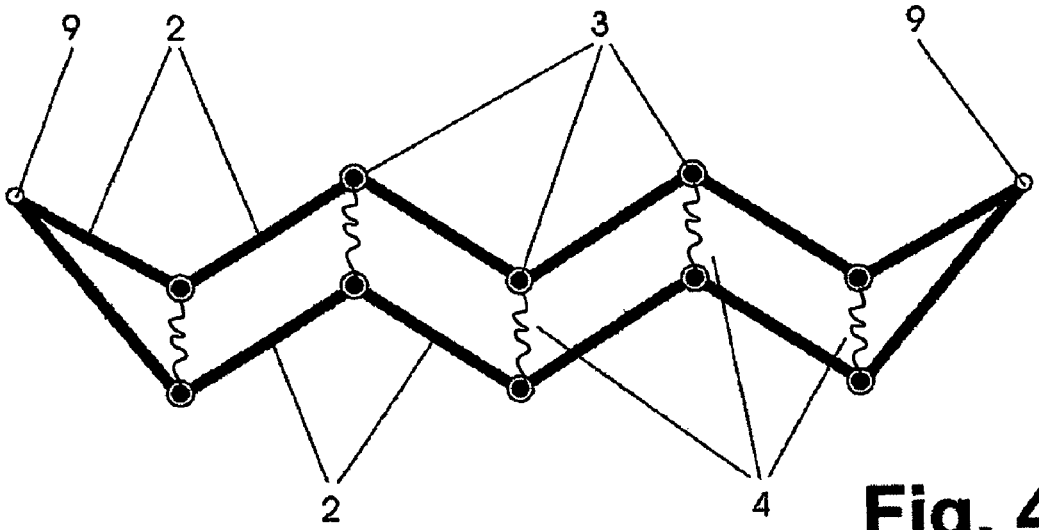
Figure 5:
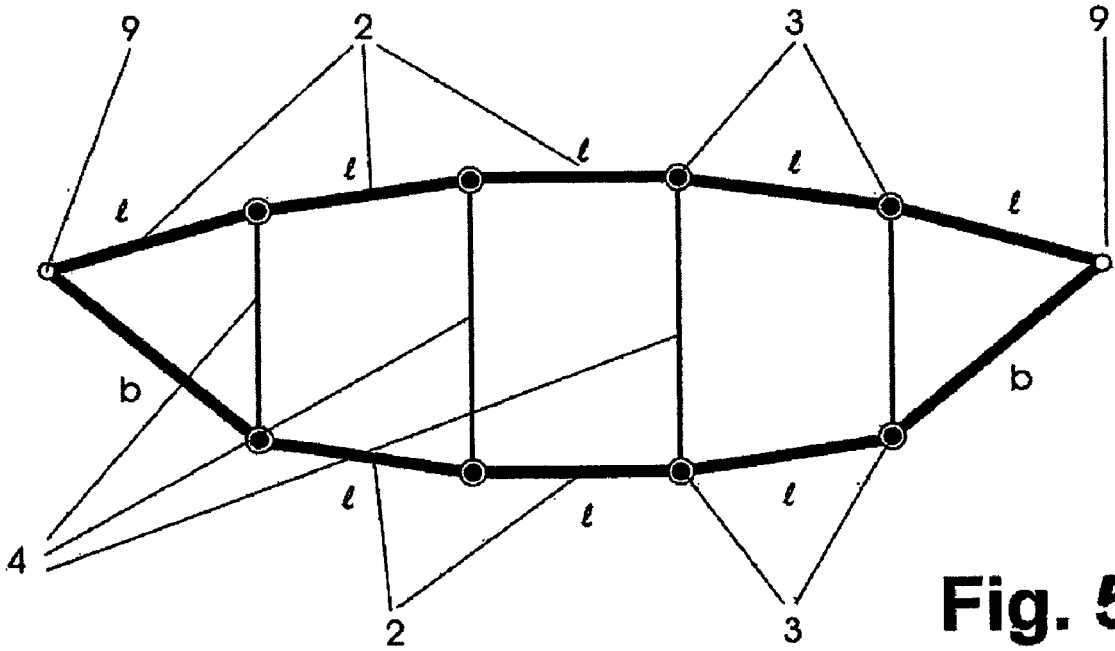
Figure 6:
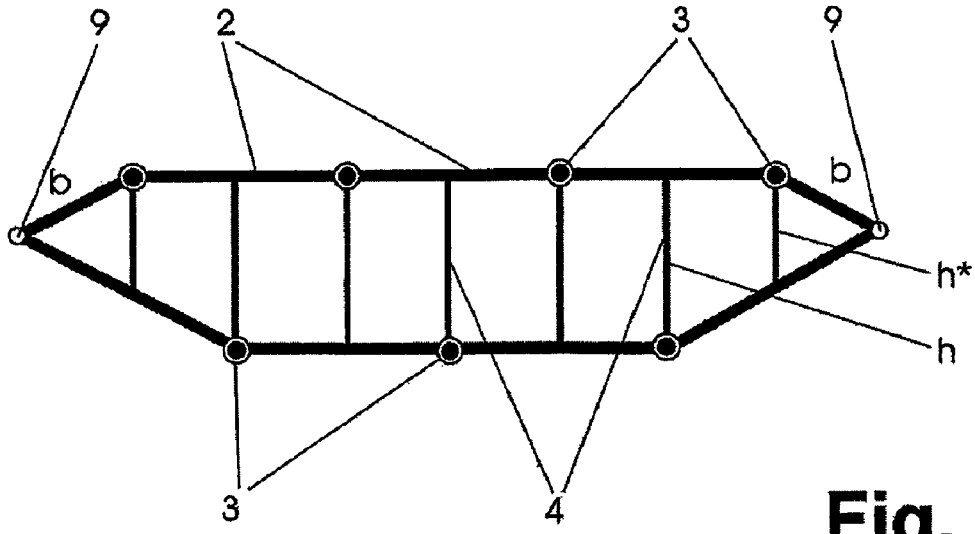
Figure 7:
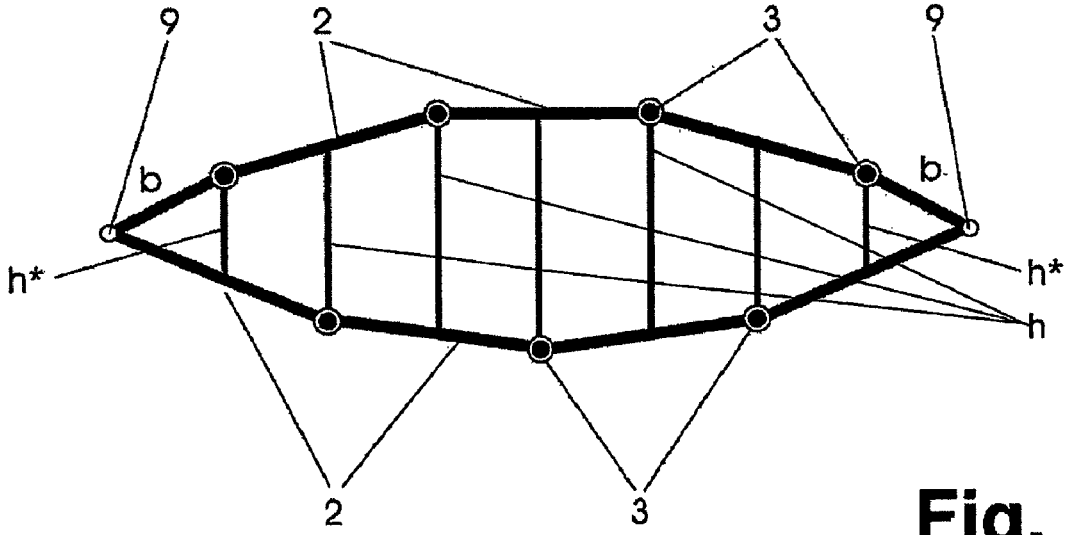
Figure 8:
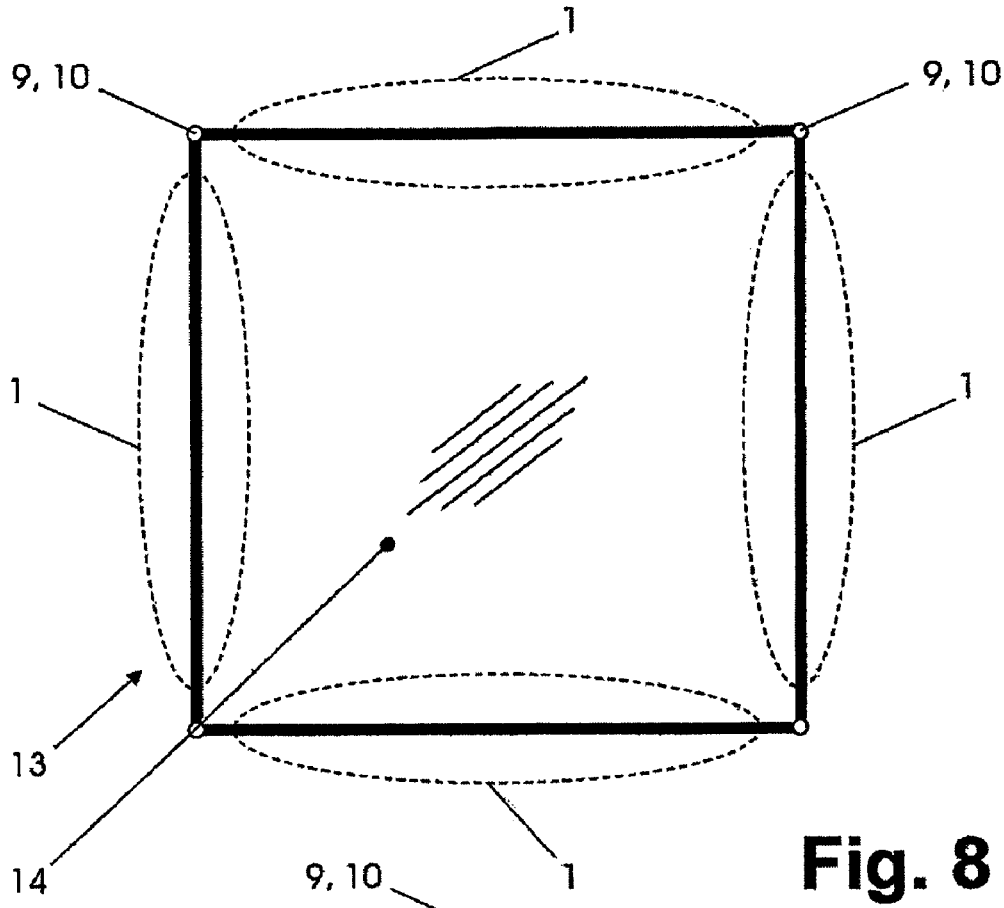
Figure 9:
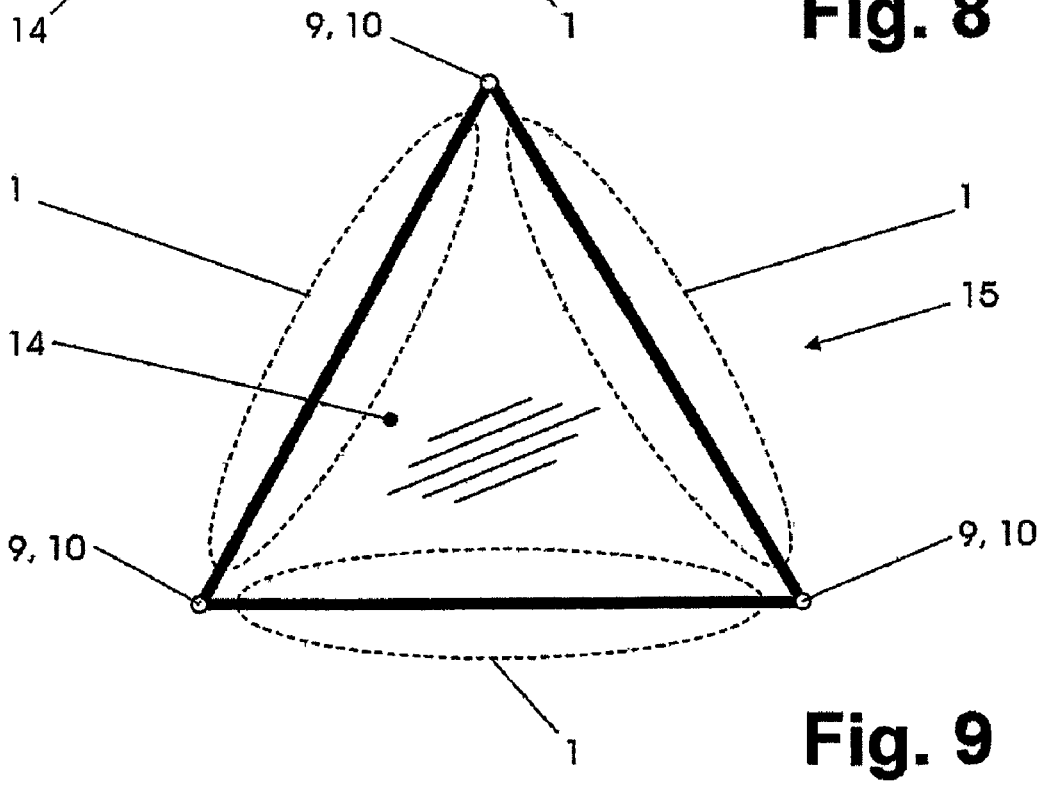
Figure 10:
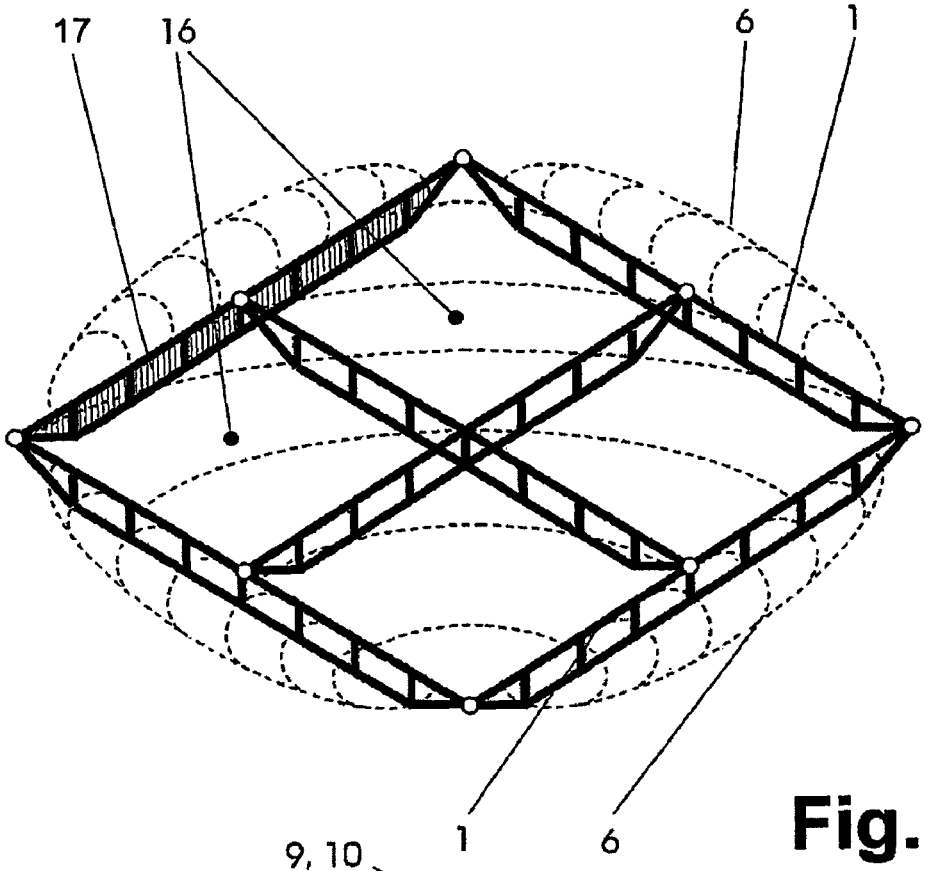
Figure 11:
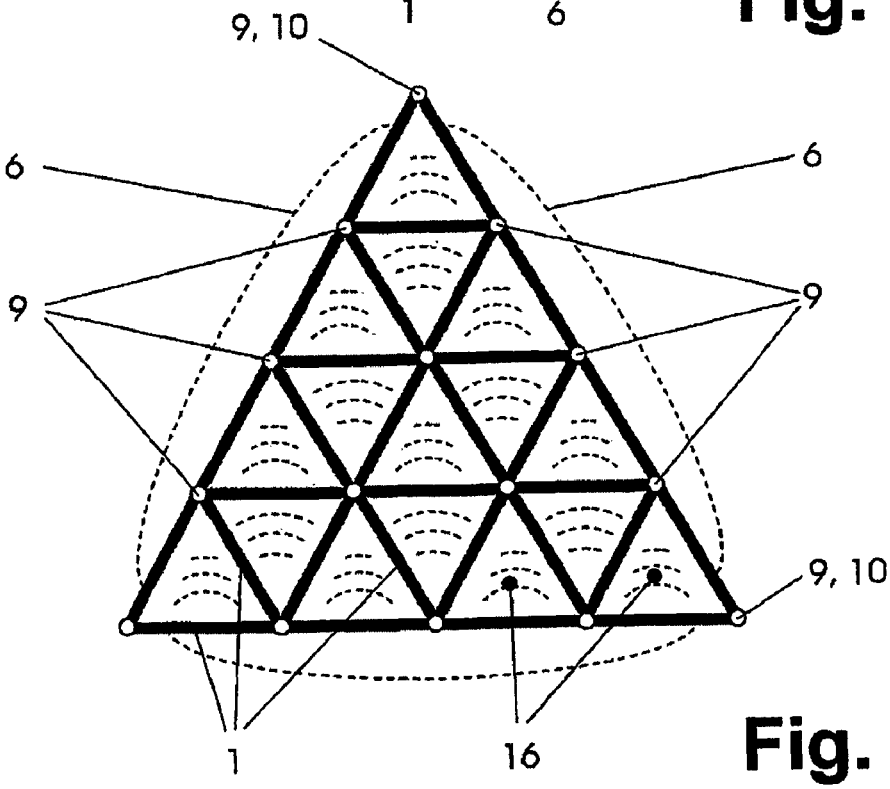
Figure 12:
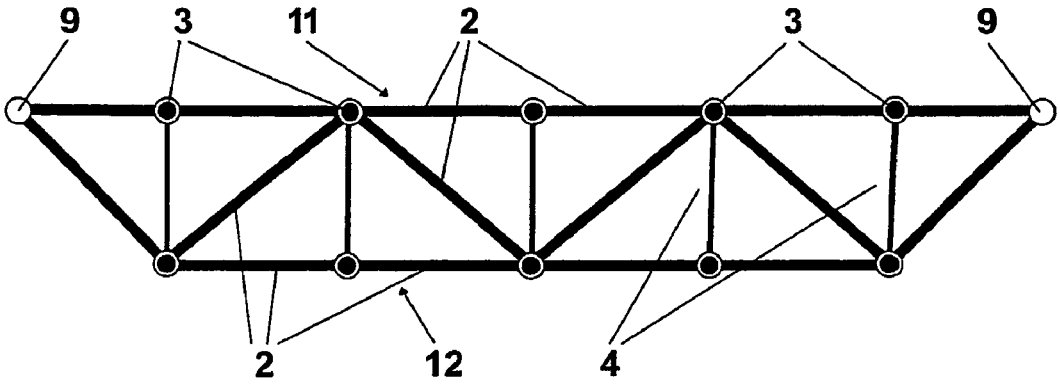
Figure 14:
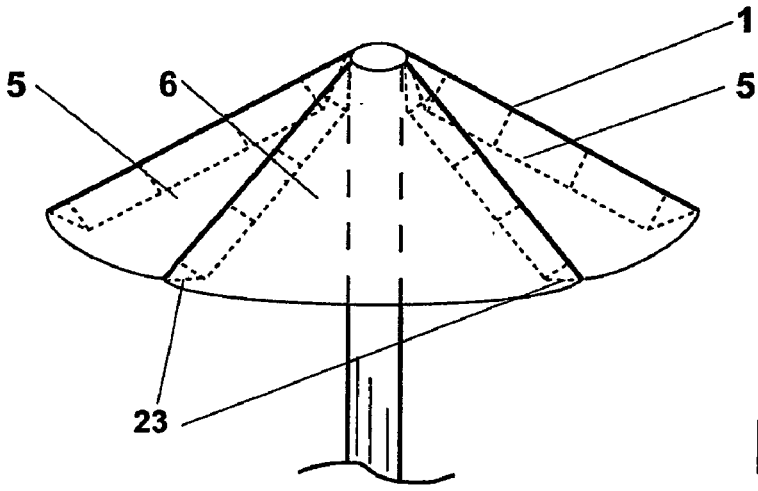
Figure 15:
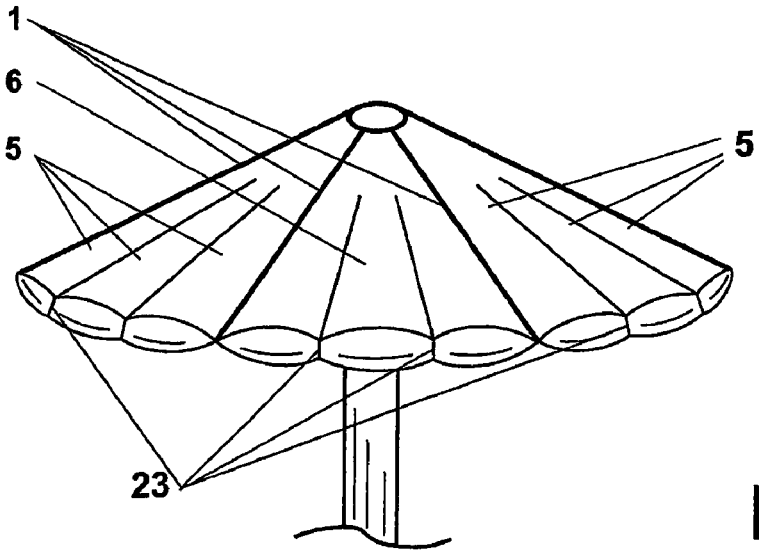
Figure 13:
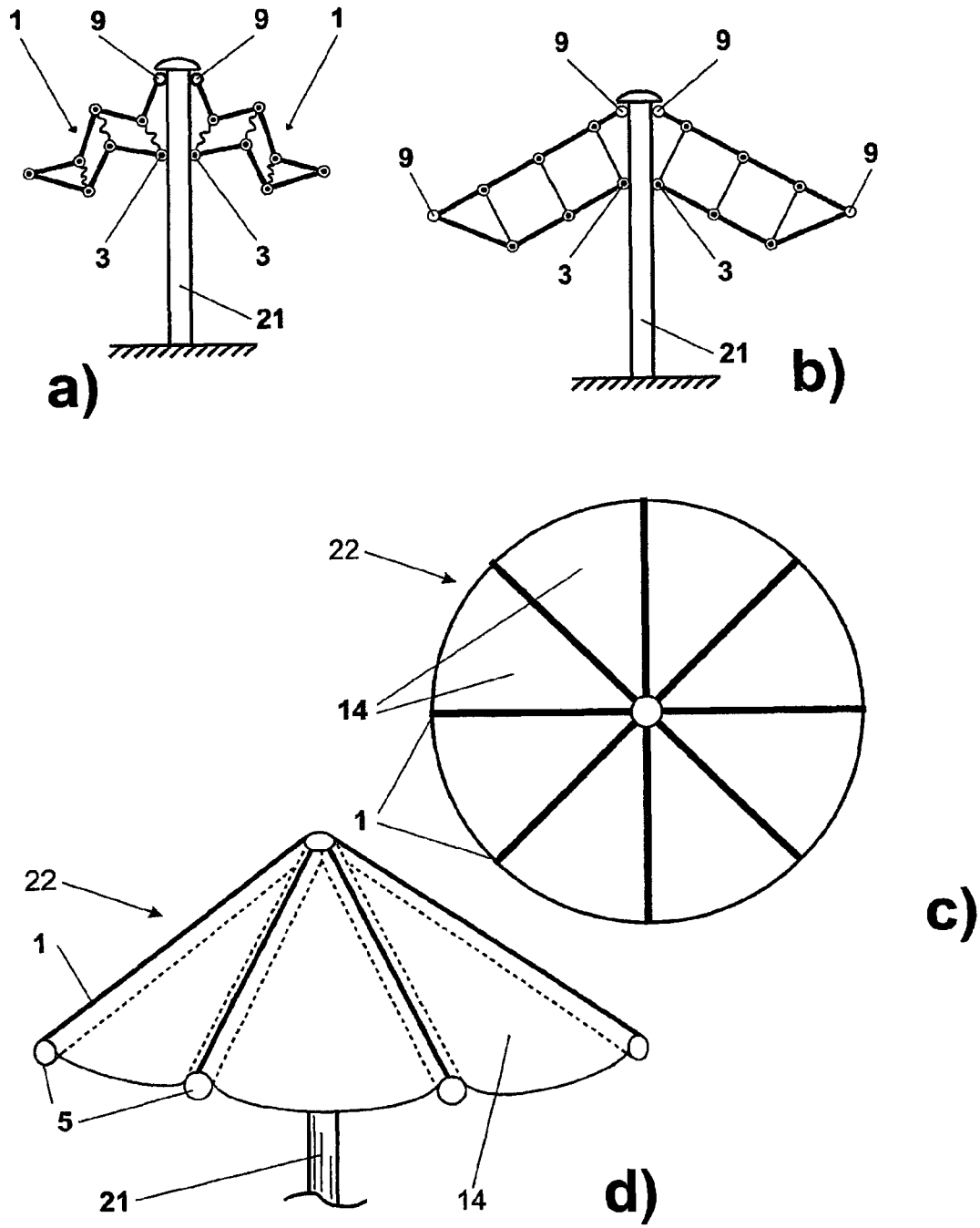

FIG. 4 shows a foldable tension-compression element of the first example embodiment, FIG. 5 shows a second example embodiment of a foldable tension-compression element in a side view, FIG. 6 shows a third example embodiment of a foldable tension-compression element in a side view, FIG. 7 shows a fourth example embodiment of a foldable tension-compression element in a side view, FIG. 8 shows a two-dimensional support framework with four tension-compression elements, FIG. 9 shows a two-dimensional support framework with three tension-compression elements, FIG. 10 shows an areal support framework with six tension-compression elements in quadrilateral form, FIG. 11 shows an areal support framework with nine tension-compression elements in triangular form, FIG. 12 shows a fifth example embodiment of a foldable tension-compression element in a side view, FIG. 13*a-d* show illustrations of an areal support framework in the form of an umbrella, FIG. 14 shows an isometric view of a variant to FIG. 13, FIG. 15 shows an isometric view of a second variant to FIG. 13.

Figure 1:
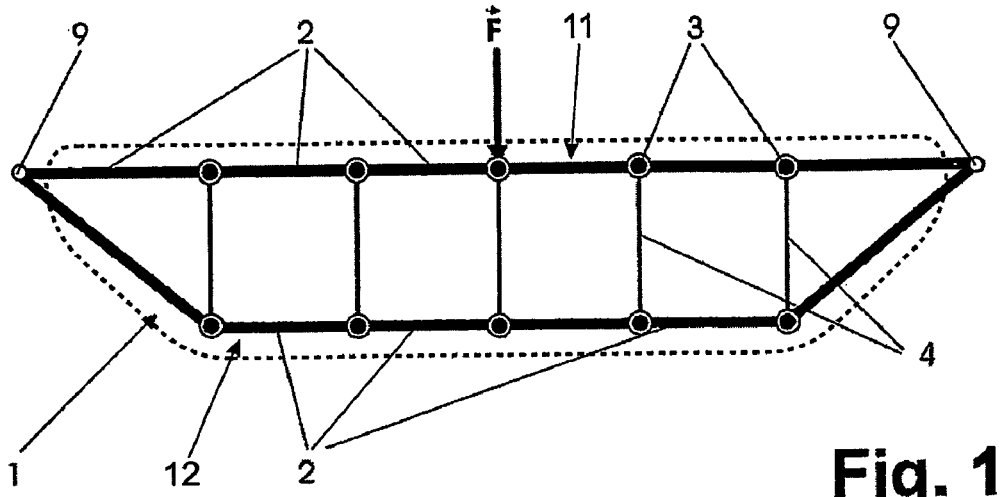
FIG. 1 shows the side view of a first example embodiment.

FIG. 1 is the diagrammatic illustration of a first example embodiment of the idea of the invention. A tension-compression element 1 is composed of several compression-pressure bars 2 which are connected with each other articulatedly in joints 3, and several tension elements 4. For example, wires, chains, cables or straps, hereinafter named tension straps 4, run between the joints 3. In the illustration according to FIG. 1, the axes of the joints 3 run perpendicularly to the plane of the drawing. The tension straps 4 are preferably constructed as wire cables and are flexible without bending. The use of tension straps 4 made of textiles or plastics, metals, and combinations of such materials, for example aramid fibres or similar materials, is likewise in accordance with the invention. Instead of in the joints 3, the tension straps 4 can also be fastened adjacent thereto. Instead of single tension strap, then respectively two thereof can be present, which cross over each other when the fastening takes place on the upper chord and lower chord alongside the joints. A possibility also exists in the fastening of the two straps on the joint on the upper chord or respectively lower chord and on the adjacent tension-compression bars of the corresponding joint of the lower chord or respectively upper chord.

In this illustration, the elements designated by 2, 3, 4 form a flat framework and are constructed as such for loads→F acting vertically from above. As a variant of the framework illustrated in FIG. 1, a variant which is not illustrated is likewise included in the idea of the invention, in which the tension-compression bars 2 are constructed to be of different length, with the restriction that respectively for each one illustrated lying above in FIG. 1 (i.e. situated in the upper chord 11), an equally long one, lying below in FIG. 1 (i.e. situated in the lower chord 12) is incorporated at the homologous location.

In this example embodiment, such a tension-compression element according to FIG. 1 is inserted into the plane of symmetry of a pneumatic element 5, as is illustrated as a cross-section in FIG. 1. This pneumatic element 5 consists of a cover 6 having tensile strength, into which for example two tube-like hollow members 7 are inserted, which are made of elastic and gas-tight material. Other solutions are likewise in accordance with the invention, but require a certain effort for sealing the pneumatic element 5 with respect to the tension-compression element 1 and the tension straps 4. For example, the two hollow members 7 can be connected or basically constitute only a single hollow member which has suitable ducts for the mechanical parts. Likewise, the cover 6 and the hollow member can be a single element when suitable seals are incorporated.

Figure 2:
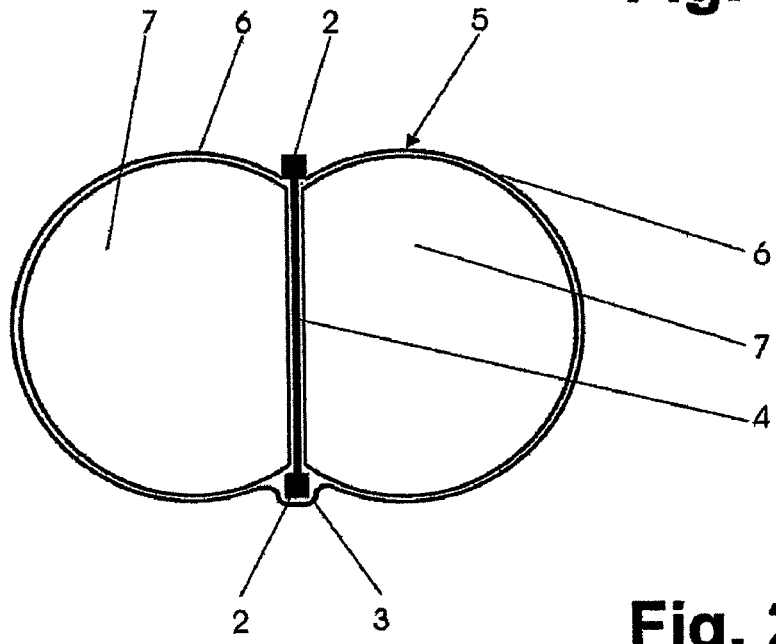
FIG. 2 shows a cross-section through the first example embodiment.

The cover 6 can also be connected with the tension-compression bars 2 by means of pockets, as illustrated in the lower part of FIG. 2. Through the linear tensions which act in the covers 6, the upper chord 11 and lower chord of the tension-compression element are stabilized laterally, because the covers apply there with their linear tensions with generally symmetrical tension forces to the left and to the right. The vector sums of these linear tensions act upwards and downwards (with respect to FIG. 2) and generate in the tension straps 4 tension forces which preload them. These tension straps 4 are therefore able to receive compression forces →F acting from the exterior (cf. FIG. 1), until the said preloading forces acting on them are compensated by the distributed compression force→F.

The pressure gas thereby undertakes three tasks:

stabilizing the joints 3, stabilizing the tension-compression bars 2 against bending, erecting the structure from the folded position.

Figure 3:
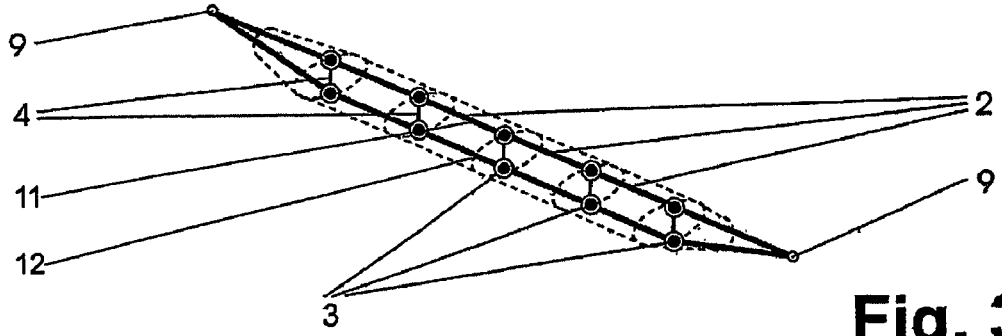
FIG. 3 shows an isometric view of the first example embodiment.

FIG. 3 shows such a support structure according to the invention in isometric view, omitting the elastic hollow members 7. At the ends of the said tension-compression element, the outermost tension-compression bars 2 are each joined together in a knot 9, optionally detachably.

FIG. 4 shows only the tension-compression element consisting of tension-compression bars 2 and tension straps 4 in the relieved and unloaded state, partially folded together. In the relieved state, the tension straps 4 are slack.

The illustration of FIG. 4 refers to the same tension-compression element as that of FIGS. 1 and 3. In this construction, the tension-compression element can be folded without the connections with the knot 9 having to be loosened.

FIG. 5 is the diagrammatic illustration of a second example embodiment of a foldable tension-compression element. Whereas the construction of the pneumatic element 5 (not illustrated here) is substantially the same, the differences of the various example embodiments lie primarily in the development of the tension-compression element. Here, the tension-compression element consists of three pairs of tension-compression bars 2, all of the same length l, in which the length of the tension straps increases towards the centre. Adjacent to the knots 9 in the so-called upper chord 11—in FIG. 5 the tension-compression bars 2 illustrated above—in each case a tension-compression bar 2 of length l is connected with a tension-compression bar 2 of length b in the lower chord 12, in which the condition b>l applies. In so far as this condition is maintained, the tension-compression element can be folded without loosening the connections in the knots 9. As in the previous, second, example embodiment, the joints 3 are again connected by tension straps 4. If the variant is selected with two tension straps 4, optionally crossing over each other, which are fastened to the upper chord and/or lower chord alongside the joints on the tension-compression bars, the connection in the knots 9 must optionally be loosened for folding the tension-compression element 1.

In FIG. 6 a third example embodiment is illustrated of a tension-compression element according to the invention. Here, the tension straps 4 run respectively from the centre of each tension-compression bar 2 to the opposite joint 3. Two short tension-compression bars 2 of the length b are connected in each case to the two knots 9, whereas all the other tension-compression bars 2 have the length l. A tension strap 4 of the length h* is arranged in each case adjacent to the knot 9. So that the illustrated tension-compression element is able to be folded, the condition $$h>h^*>l/2$$

applies for h*.

As a further condition for the foldability, in this example embodiment it applies that the connection of each of the two tension-compression bars 2, which converge in the knot 9, can be loosened.

In the example embodiment according to FIG. 7, the tension straps 4 again run respectively as in the previous example embodiment, from the centre of each tension-compression bar 2 to the opposite joint 3. All the tension-compression bars 2 are of the same length l with the exception of those lying above in FIG. 7, adjoining the knots 9. These each have a length b<l. In order to make possible the foldability of the tension-compression element according to FIG. 7, again two tension straps are provided with a condition:

$$h^*>l/2.$$

In addition, here also the connection of the adjacent tension-compression bars 2 in the knot 9 must be loosened. For the lengths h of the other tension straps 4, the following applies $$h>h^*.$$

In FIG. 8 to 11, support structures according to the invention are illustrated, which extend in two dimensions and therefore basically constitute areal support frameworks. Thus, FIG. 8 shows a first areal support framework which is constructed from four support structures arranged in a rectangle 13. The support structures coming into use here can consist of one of the example embodiments already illustrated. They are respectively connected with each other in the knots 9 and form there a real or virtual joint 10. The said rectangle 13 is spanned by a suitable membrane 14 and forms therewith for example a roof or a screen. Possible drains for rainwater are not illustrated, but can be provided at suitable locations.

In an analogous manner to FIG. 8, in the example embodiment according to FIG. 9 a triangle 15 is formed from three—not necessarily identical—linear support structures, again according to one of the previously described example embodiments. Here, also, a taut membrane 14 covers the support structure.

The tensile stresses occurring in the example embodiments according to FIG. 8, 9 and hence tilting moments and lateral bending moments in the tension-compression elements 1 can be at least partially compensated by the fastenings in the joints 10 and by a wider development of the tension-compression bars 2.

FIG. 10 is the illustration of an areal support framework according to the invention. It is constructed from six basically similar foldable tension-compression elements 1, for example from that according to FIG. 1. The half of a cover 6 with an elastic hollow member 5 (not illustrated) lying therein is arranged respectively on the outer side of each tension-compression element. In the four fields between the foldable tension-compression elements 1, four air chambers 16 are arranged, which are either connected in a gas-tight manner to the tension-compression elements 1, or are provided in turn with elastic and gas-tight hollow bodies. As the radii of curvature of the covers 6 and of the air chambers 16 are greatly different and the linear tension in their covers runs proportionally to the pressure and to the radius of curvature, $$\sigma=p\cdot R$$

it can be expedient, at least on the side of the higher pressure, i.e. on that of the covers 6, to insert a cross-piece 17 which connects the upper chord 11 with the lower chord 12 of each tension-compression element 1 here vertically and parallel to the plane of the tension-compression bars 2 and tension straps 4 on the side of the higher pressure. Such a cross-piece does not need to be gas-tight, if the air chambers 16 are themselves gas-tight. The cross-piece is constructed so that it does not prevent the folding of the system.

An analogous example embodiment to that of FIG. 10 is illustrated in FIG. 11. It is based on a triangular basic grid corresponding to that of FIG. 9. An outer frame, constructed on three tension-compression elements 1 each with a half cover 6, for example again each with an elastic hollow member 5 (not visible), carries a flat arrangement of tension-compression elements 1 crossing over each other according to one of the preceding corresponding example embodiments. The knots 9 lie respectively on this outer frame. In the present illustration, thus 16 triangular chambers are formed, which are again constructed as air chambers 16. The boundary areas to the half covers 6 can again contain cross-pieces 17, in order to prevent a passage of the hollow members 7 through between the tension straps 4.

In a further example embodiment according to FIG. 12, as a supplement to that of FIGS. 1, 5, 6 and 7, further tension-compression bars 2 are included. These run respectively from a joint 3 in the upper chord 11 to the joint 3, adjacent to the right and/or to the left, in the lower chord 12. These do not prevent the folding process, but can increase the rigidity of the tension-compression element, depending on the case of load, by receiving compression forces.

FIG. 13 to 15 are illustrations of a further areal support framework, here in the form of an umbrella 22. In FIG. 13*a* a stand 21 is illustrated, on which a number of foldable tension-compression elements, for example according to FIG. 1, is articulatedly connected, at least in a knot, the inner knot 9. The joint 3 lying beneath the inner knot 9 in FIG. 13*a* can rest on the stand 21 or can be fastened so as to be movable to a limited extent. FIG. 13*b* shows the tension-compression elements 1—without the pneumatic elements 5—in the unfolded and extended state. FIG. 13*c* shows the umbrella 22 in plan view. A first variant embodiment according to FIG. 13*d* shows how each tension-compression element 1 is surrounded by two pneumatic elements 5, as illustrated in FIGS. 2 and 3. In this variant embodiment, a membrane 14 is included in between the individual tension-compression elements 1, which membrane 14 is tensioned by the filling of the pneumatic elements, together with the unfolding of the tension-compression elements 1.

FIG. 14 shows a second variant embodiment. The field between two adjacent tension-compression elements 1 is respectively filled by a single pneumatic element 5, which provides both for the tensioning of the tension straps 4 and also for the lateral stabilizing of the tension-compression elements 1.

In FIG. 15 a third variant embodiment of the umbrella 22 is illustrated. Here, cross-pieces 23 are included into the pneumatic elements 5, which cross-pieces 23 in each case connect the under and upper sides of the cover 6 with each other. Hollow members 7—optionally elastic—are inserted for example again between the cross-pieces 23. Compared with the second variant according to FIG. 14, this third variant has the advantage of being substantially thinner in construction.

The pressure gas with which the hollow members 5 are filled can be compressed air or another gas. The gas can be heavier than air—for example $CO_2$—or lighter than air, such as for example so-called balloon gas or hydrogen.

The invention claimed is:

1. A pneumatic support comprising:

a framework comprising:

an upper chord and a lower chord, the upper chord operatively coupled to the lower chord by at least one knot disposed at an end of the framework, the upper chord and the lower chord each comprising a plurality of tension-compression bar segments, each tension-compression bar segment of the plurality of tension-compression bar segments coupled to a successive tension-compression bar segment in a plurality of articulated joints;

a plurality of tension straps connecting the upper chord and the lower chord, each tension strap of the plurality of tension straps connected to the upper chord and the lower chord in a region of each articulated joint of the plurality of articulated joints;

at least one pneumatic element for containing a compressed gas the at least one pneumatic element arranged on a side of the framework;

wherein, upon filling the at least one pneumatic element with the compressed gas, forces are generated in the framework that preload the plurality of tension straps, stabilize the plurality of articulated joints, and secure the plurality of tension-compression bar segments against bending;

wherein the framework and the at least one pneumatic element are foldable when the at least one pneumatic element is not filled with the compressed gas; and wherein the framework and the at least one pneumatic element can be erected from an empty state into a state ready for operation by filling the at least one pneumatic element with the compressed gas.

2. The pneumatic support according to claim 1, wherein the at least one pneumatic element comprises a single pneumatic element.

3. The pneumatic support according to claim 2, wherein the at least one pneumatic element comprises a shared cover.

4. The pneumatic support according to claim 1, wherein the at least one pneumatic element comprises a cover and an air-tight hollow member.

5. The pneumatic support according to claim 4, wherein the air-tight hollow member comprises an elastic material.

6. The pneumatic support according to claim 1, wherein a connection of the plurality of tension-compression bar segments to the at least one knot is loosened to facilitate folding of the framework.

7. The pneumatic support according to claim 1, wherein:

the plurality of articulated joints comprises a first group of articulated joints in the upper chord and a second group of articulated joints in the lower chord;

the first group of articulated joints in the upper chord are situated at homologous locations to the second group of articulated joints in the lower chord; and the first group of articulated joints are connected to the second group of articulated joints by the plurality of tension straps fastened at each joint of the plurality of articulated joints.

8. The pneumatic support according to claim 1, wherein the plurality of tension straps are fastened to the plurality of articulating joints.

9. The pneumatic support according to claim 7, wherein:

each tension strap of the plurality of tension straps are of equal length; and the upper chord and the lower chord are substantially parallel to each other.

10. The pneumatic support according to claim 7, wherein:

a length of each tension strap of the plurality of tension straps increases from the at least one knot towards a centre of the framework;

the upper chord and the lower chord each comprise a curved shape;

substantially all of the tension-compression bar segments of the plurality of tension-compression bar segments comprise an identical length; and a plurality of outermost tension-compression bar segments of the lower chord comprise a length less than the identical length.

11. The pneumatic support according to claim 10, wherein:

the plurality of articulated joints comprises a first group of articulated joints in the upper chord and a second group of articulated joints in the lower chord;

a first plurality of centres of the plurality of tension-compression bar segments of the upper chord are situated at homologous locations to the second group of articulated joints in the lower chord;

a second plurality of centres of the plurality of tension-compression bar segments of the lower chord are situated at homologous locations to the first group of articulated joints in the upper chord;

the plurality of tension straps connect the first plurality of centres with the second group of articulated joints in the lower chord; and the plurality of tension straps connect the second plurality of centres with the first group of articulated joints in the upper chord.

12. The pneumatic support structure according to claim 11, wherein:

each tension strap of the plurality of tension straps are of equal length; and the upper chord and the lower chord are substantially parallel to each other.

13. The pneumatic support according to claim 11, wherein:

a length of each tension strap of the plurality of tension straps increases from the at least one knot towards a centre of the framework;

the upper chord and the lower chord each comprise a curved shape;

substantially all of the tension-compression bar segments of the plurality of tension-compression bar segments comprise an identical length; and a length of a plurality of outermost tension straps of the plurality of tension straps on each side of the framework is greater than half of the identical length.

14. A structure, comprising:

a plurality of pneumatic supports, the plurality of the plurality of pneumatic supports operatively coupled to each other;

a membrane spanned between the plurality of pneumatic support structures;

wherein each pneumatic support of the plurality of pneumatic supports comprises:

a framework comprising:

an upper chord and a lower chord, the upper chord and the lower chord operatively coupled to each other by at least one knot disposed at an end of the framework, the upper chord and the lower chord each comprising a plurality of tension-compression bar segments, each tension-compression bar segment of the plurality of tension-compression bar segments coupled to a successive tension-compression bar segment in a plurality of articulated joints; and a plurality of tension straps connecting the upper chord and the lower chord, each tension strap of the plurality of tension straps connected to the upper chord and the lower chord in a region of each articulated joint of the plurality of articulated joints;

at least one pneumatic element for containing a compressed gas, the at least one pneumatic element arranged on a side of the framework;

wherein, upon filling the at least one pneumatic element with the compressed gas, forces are generated in the framework that preload the plurality of tension straps, stabilize the plurality of articulated joints, and secure the plurality of tension-compression bar segments against bending;

wherein the framework and the at least one pneumatic element are foldable when the at least one pneumatic element is not filled with the compressed gas; and wherein the framework and the at least one pneumatic element can be erected from an empty state into a state ready for operation by filling the at least one pneumatic element with the compressed gas.

15. The structure according to claim 14, the plurality of pneumatic supports are coupled to each other at the at least one knot.

16. The structure according to claim 14, wherein:

the plurality of pneumatic supports comprises four pneumatic supports arranged in a quadrilateral and operatively coupled to each other at the at least one knot;

a first framework is operatively coupled to a center of oppositely-disposed pneumatic supports of the four pneumatic supports and a second framework is arranged generally perpendicular to the first framework, the first framework and the second framework each comprising:

an upper chord and a lower chord, the upper chord operatively coupled to the lower chord by a knot disposed at an end of the framework, the upper chord and the lower chord each comprising a plurality of tension-compression bar segments, each segment of the plurality of tension-compression bar segments coupled to a successive segment in a plurality of articulated joints; and a plurality of tension straps connecting the upper chord and the lower chord, each strap of the plurality of tension straps connected to the upper chord and the lower chord in a region of each joint of the plurality of articulated joints;

the four pneumatic supports, the first framework, and the second framework together define four fields;

a cover is arranged with a hollow member, the cover being connected to at least one of the four pneumatic supports; and the four fields each comprising an air chamber the air chamber being gas-tight and operable to be filled with compressed air.

17. The structure according to claim 16, wherein the air chambers are closed off in a gas-tight manner.

18. The structure according to claim 14, comprising:

the plurality of pneumatic supports comprises three pneumatic supports arranged in a triangle and connected to each other at the at least one knot;

the plurality of pneumatic supports being arranged so that, the three pneumatic supports form a triangle, with an outer frame;

a second plurality of pneumatic supports arranged respectively with the at least one knot on the plurality of pneumatic supports;

a cover disposed on an outer side of the outer frame, the cover having a hollow member;

the cover being connected respectively with the plurality of pneumatic supports; and a plurality of triangular fields defined by the plurality of pneumatic supports, the plurality of triangular fields comprising a gas-tight air chamber, the gas-tight air chamber operable to be filled with compressed air.

19. The structure according to claim 14, wherein:

the plurality of pneumatic supports are operatively coupled to a stand and are arranged radially outwards therefrom;

a first articulated joint of the lower chord rests on the stand; and the plurality of pneumatic supports and the stand together form an umbrella.

20. The structure according to claim 16, wherein the at least one pneumatic element takes up an entire intermediate space between adjacent frameworks.

21. The structure according to claim 17, wherein the at least one pneumatic element comprise a plurality of substantially vertical cross-pieces, whereby an overall height of the at least one pneumatic element is reduced.

22. The pneumatic support according to claim 1, wherein the at least one pneumatic element is filled with a gas.

23. The structure according to claim 14, wherein the at least one pneumatic element is filled with a gas.

* * * * *

UNITED STATES PATENT AND TRADEMARK OFFICE

CERTIFICATE OF CORRECTION

PATENT NO. : 8,161,687 B2
APPLICATION NO. : 12/308416
DATED : April 24, 2012
INVENTOR(S) : Rene Crettol et al.

It is certified that error appears in the above-identified patent and that said Letters Patent is hereby corrected as shown below:

In the Claims:

Column 6, Lines 3-4, Claim 1

Replace "compressed gas the at least one"
with -- compressed gas, the at least one --

Column 7, Line 16, Claim 12

Replace "The pneumatic support structure according to claim 11,"
with -- The pneumatic support according to claim 11, --

Signed and Sealed this
Fourth Day of September, 2012

David J. Kappos

David J. Kappos
*Director of the United States Patent and Trademark Office*